US008177613B2

(12) United States Patent
Slattery et al.

(10) Patent No.: US 8,177,613 B2
(45) Date of Patent: May 15, 2012

(54) TRIVIA QUESTION WAGERING SYSTEM

(75) Inventors: Derek Justin Slattery, Pasadena, CA (US); Jason Bryant Coxsey, San Diego, CA (US)

(73) Assignee: Danger Room Gaming, B.V., San Diego, CA (US)

( * ) Notice: Subject to any disclaimer, the term of this patent is extended or adjusted under 35 U.S.C. 154(b) by 284 days.

(21) Appl. No.: 12/710,049

(22) Filed: Feb. 22, 2010

(65) Prior Publication Data

US 2011/0207514 A1 Aug. 25, 2011

(51) Int. Cl.
*A63F 9/24* (2006.01)

(52) U.S. Cl. ..... 463/9; 463/42

(58) Field of Classification Search ..... 463/9, 42, 463/16–30; 273/460; 434/323, 332
See application file for complete search history.

(56) References Cited

U.S. PATENT DOCUMENTS

| | | | | |
|---|---|---|---|---|
| 6,193,606 | B1 * | 2/2001 | Walker et al. | 463/20 |
| 6,394,899 | B1 * | 5/2002 | Walker | 463/9 |
| 7,326,115 | B2 | 2/2008 | Baerlocher | |
| 7,351,149 | B1 * | 4/2008 | Simon et al. | 463/42 |
| 7,651,095 | B1 * | 1/2010 | Pillalamarri et al. | 273/274 |
| 7,758,048 | B1 * | 7/2010 | Crapuchettes et al. | 273/274 |
| 2002/0004424 | A1 | 1/2002 | Nelson et al. | |
| 2002/0037767 | A1 | 3/2002 | Ebin | |
| 2002/0143652 | A1 | 10/2002 | Beckett | |
| 2007/0057470 | A1 * | 3/2007 | Mohr | 273/432 |
| 2007/0259709 | A1 | 11/2007 | Kelly et al. | |
| 2008/0242423 | A1 * | 10/2008 | Kerr et al. | 463/42 |
| 2009/0318219 | A1 | 12/2009 | Koustas et al. | |

FOREIGN PATENT DOCUMENTS

WO WO-2004/063848 7/2004

* cited by examiner

*Primary Examiner* — Masud Ahmed
(74) *Attorney, Agent, or Firm* — Foley & Lardner LLP

(57) ABSTRACT

A method and system for providing a pari-mutuel wagering environment is presented. The method includes receiving a wager amount at a server from each of a plurality of players, allocating a portion of each wager amount to a payout pool, and allocating a second portion of each wager amount to a jackpot. The method further includes simultaneously presenting a question to the plurality of players and receiving answers to the question from the players. The method also includes allocating pro rata shares of the payout pool to each player that answers the question correctly, and, if a specified percentage of the players answer the question correctly, allocating pro rata shares of the jackpot to each of the players that answered the question correctly. The system further includes a plurality of remote terminals and servers for performing the method.

26 Claims, 8 Drawing Sheets

TRIVIA QUESTION WAGERING SYSTEM

FIELD

The subject of the disclosure relates generally to gaming over a network. More specifically, the disclosure relates to a system that provides online gaming and pari-mutuel wagering.

SUMMARY

The proliferation of the Internet has transformed recreational opportunities for individuals across the globe. A number of Web sites are available via the Internet which permit users to simultaneously participate in various games of skill and chance. For example, on the Yahoo! Games website, users may play a variety of games including card games, board games, arcade games, puzzles, word games, as well other games involving skill and/or chance. Various gambling websites allow users to gamble on sports events, casino games, bingo and live racing.

A key component to the success of such websites, involves the ability of the website to attract large numbers of visitors and players. As such, websites and gaming systems that offer players unique incentives to visit such sites and participate in its games are often more popular and profitable than websites or gaming systems that lack such incentives.

In addition, many online gaming websites offer payouts with unknown odds that may greatly disadvantage the individual players. A pari-mutuel wagering system is herein described in which players may participate in a game that offers substantially true odds payouts that may be approximately equal to or greater than the player's wager amount. The system may keep only a small portion of the wager amount and may allocate a majority of the remaining portion to a payout pool with smaller portions allocated to a jackpot and a player referral bonus.

A representative embodiment involves a method performed by a server. The method includes receiving a wager amount from each of a first plurality of players, allocating a first portion of each wager amount to a payout pool, and allocating a second portion of each wager amount to a jackpot. The method further includes causing a simultaneous presentation of a question to the players and receiving a plurality of answers to the question from the players. The method additionally includes allocating pro rata shares of the payout pool to each player that answered the question correctly and, in response to a specified percentage of the players answering the question correctly, allocating pro rata shares of the jackpot to each of the players that answers the question correctly.

In a second representative embodiment, a system includes a plurality of remote terminals that are connected to one or more servers. The remote terminals receive a wager amount from each of a first plurality of players, to simultaneously present a question to the players, and to receive answers to the question from the players. The servers receive the wager amounts from the remote terminals, allocate a first portion of each wager amount to a payout pool, and allocate a second portion of each wager amount to a jackpot. The servers additionally send instructions to the remote terminals to simultaneously present the question to the players and receive the plurality of answers to the question from the plurality of remote terminals. Furthermore, the servers allocate pro rata shares of the payout pool to each player that answers the question correctly, and, in response to a specified percentage of the players answering the question correctly, allocate pro rata shares of the jackpot to each of the players that answers the question correctly.

A third representative embodiment includes a tangible computer-readable medium that has computer-executable instructions stored thereon. Upon execution by a computing device, the instructions cause the computing device to perform a method that includes receiving a wager amount from each of a plurality of players, allocating a first portion of each wager amount to a payout pool, and allocating a second portion of each wager amount to a jackpot. The method also includes simultaneously presenting a question to the players and receiving a plurality of answers to the question from players. Furthermore, the method includes allocating pro rata shares of the payout pool to each player that answers the question correctly, and, in response to a specified percentage of the players answering the question correctly, allocating pro rata shares of the jackpot to each of the players that answers the question correctly.

Other principal features and advantages will become apparent to those skilled in the art upon review of the following drawings, the detailed description, and the appended claims.

BRIEF DESCRIPTION OF THE DRAWINGS

Representative embodiments are hereafter described with reference to the accompanying drawings.

DETAILED DESCRIPTION

In an embodiment, a system is provided for simultaneously presenting trivia questions to and receiving answers from a plurality of players. Note that the system is not limited to the embodiment of trivia questions. While the specification may refer to a trivia game and trivia questions, the system can be implemented with any type of game or activity of chance or skill. In an embodiment, each of the plurality of players wagers a selected amount of units (e.g., money or credits). The wagers are placed into a pool. Each player that answers the question correctly is rewarded with a portion of the total units in the pool, while each player that answers incorrectly loses their wager.

Figure 1:
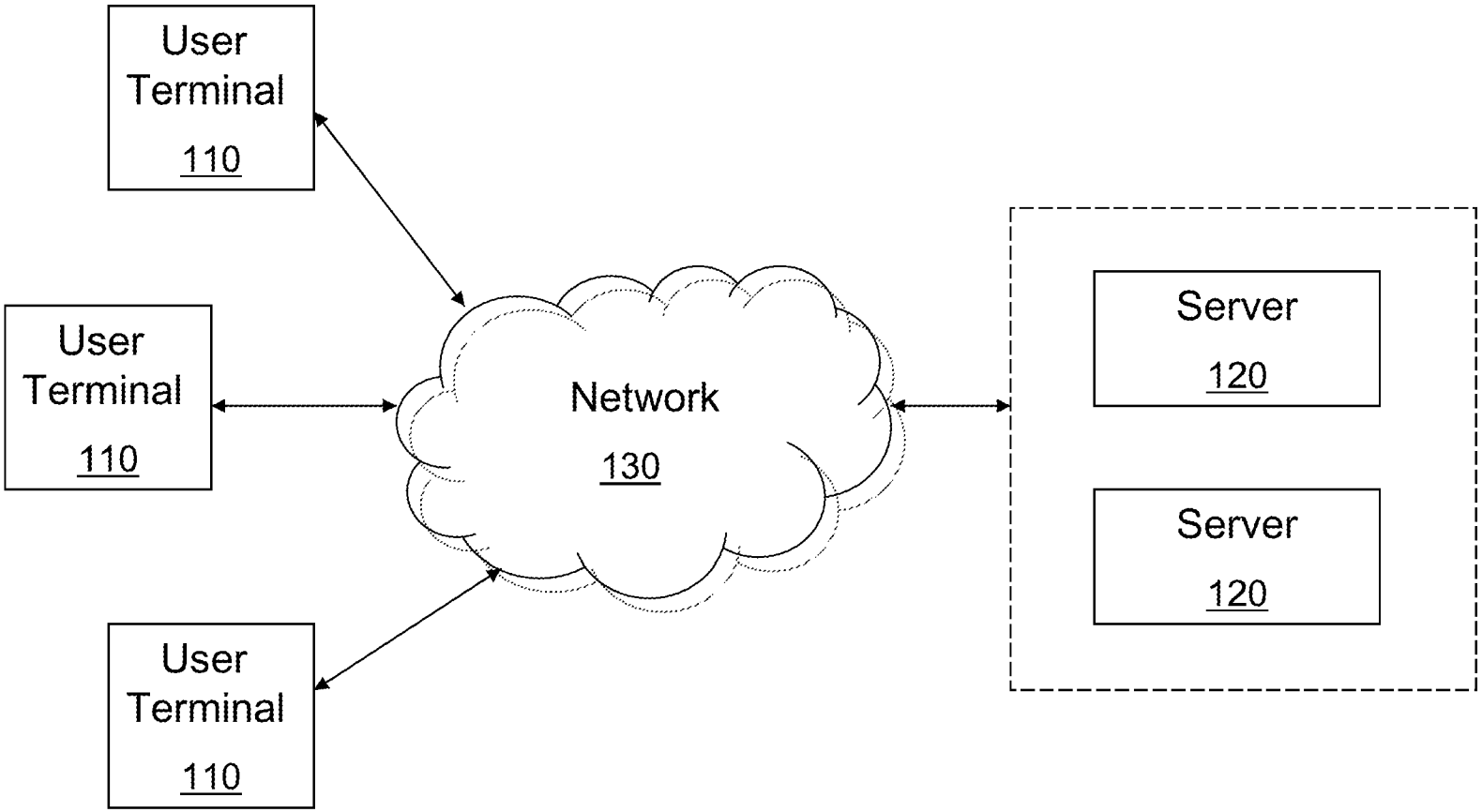
FIG. 1 is a block diagram illustrating a system for simultaneously presenting trivia questions to and receiving answers from a plurality of players in accordance with a representative embodiment.

FIG. 1 is a block diagram illustrating a system for simultaneously presenting trivia questions to and receiving answers from a plurality of players in accordance with a representative embodiment. A plurality of user terminals 110 are connected to one or more servers 120 via a network 130. Network 130 may be the Internet, an extranet, an intranet, or any type of network that enables terminals 110 to communicate with server 120. In a representative embodiment, server 120 provides a website or other site to user terminals 110 over network 130. User terminals 110 may be personal computers, work stations, or any other type of computing device known to those of skill in the art. In an embodiment, players may gain access to the web site via a browser executed at user terminals 110.

Figure 2:
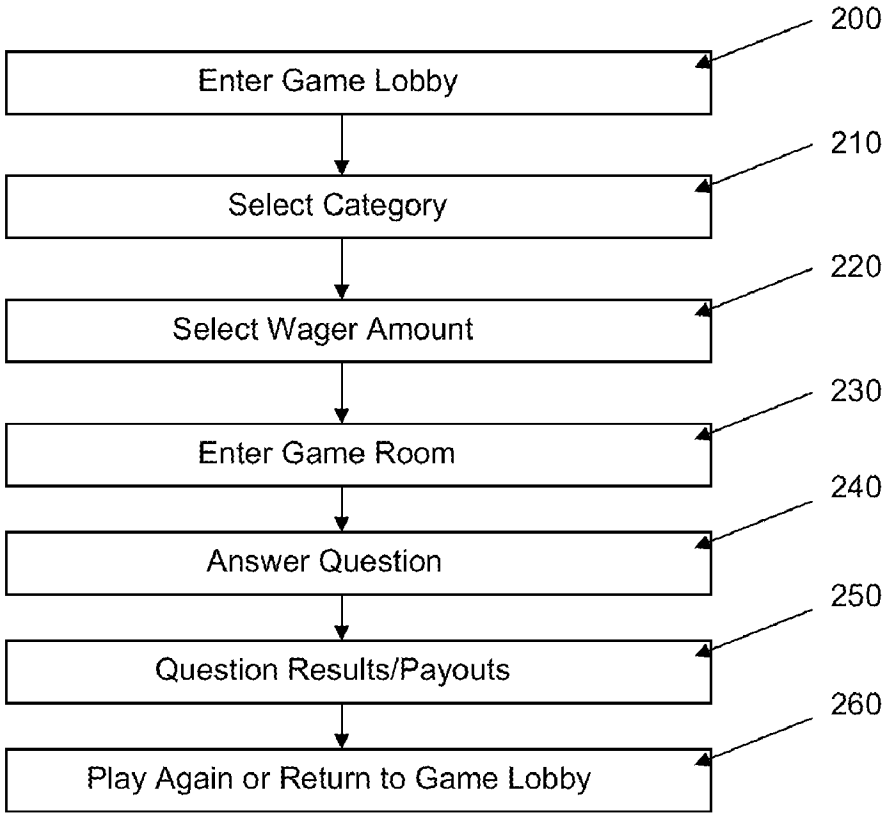
FIG. 2 is a flow diagram illustrating operations performed by a user of the system in accordance with a representative embodiment.

FIG. 2 is a flow diagram illustrating operations performed by a player via user terminals 110. The operations are not limited solely to those described below and additional, fewer, or different operations may be performed according to alternative embodiments. In an operation 200, the player navigates to a website provided by the system and enters a game lobby. The game lobby may be any type of web page or other interface from which the player may select from various types of games, various categories of questions, various wager amounts, various game rooms, etc. In an operation 210, the player selects a trivia category, e.g., sports, entertainment, history, etc. Any number of categories or type of category may be utilized by the system and presented to the player.

In an operation 220, the player selects a specific wager amount. The wager amount may be determined solely by the player, or the player may select from a number of wager amounts displayed by the system. The wager amounts may include any type of unit, for example, money or credits. In a representative embodiment, the system utilizes credits that correspond to $0.25 (U.S. Dollars). In alternative embodiments, the credits may correspond to any type of denomination of currency.

In an embodiment, a player may set up an account with the system. The player may set up the account by submitting personal information to the system and creating a user ID and password. The player may then deposit money into the account via electronic funds transfer, check, or any other process known to those of skill in the art. In an embodiment, the money deposited into the account is automatically converted into credits based on the denomination of credit and the currently utilized by the system. In alternative embodiments, the player may also receive additional promotional credits to their account which may be backed by the system, an advertiser, or any other entity.

The wager amounts selected by the player are deducted from the player's account balance. In an alternative embodiment, the player submits the money to the system at the time of the wager.

Players are grouped together based on their wager amounts. In an operation 230, the player enters a game room which includes each of the players that have been grouped together. In an embodiment, the system displays the number of players that enter the game room, names of the other players in the game room, the total payout pool available to win, and/or a current jackpot amount.

A trivia question is simultaneously presented to each of the players in the game room. The players are given a set period of time to answer the question. The set period of time may be any amount of time desired by the system administrator. In a representative embodiment, the set period of time is 15 seconds or less. A short period of time reduces the likelihood of players attempting to consult outside resources for answers to the trivia question. In an embodiment, the period of time is displayed to the user as a timer. The timer begins when the question is presented to the players and counts down to zero. The timer that is displayed to all players is a direct outbound time display that corresponds to the server time. The time that each player has to answer the question is the same.

In an operation 240, the player submits an answer to the question. In a representative embodiment, the answer is presented as a multiple choice question. In response to a multiple choice question, the player submits an answer by selecting one of a set number of possible answers. The questions may include any number of possible answers. In alternative embodiments, the question may have a form other than that of a multiple choice question. For example, the question may be a true or false question, a question in which the player fills in a blank by typing in an answer, or any other type of question known to those of skill in the art.

After the set period of time has elapsed, the answers are analyzed. If a player fails to submit an answer, the player is deemed to have submitted an incorrect answer. In an operation 250, the results are displayed on a results screen, and the associated payouts are credited to the players submitting the correct answer. The payouts are determined according to a payout pool and a jackpot which include portions of the wagers submitted by the players that participated in the trivia question. In an embodiment, the payout pool is divided evenly among the players that answered the question correctly. The jackpot is triggered if more than a predetermined percentage of the players that participated in the question, answer the question correctly. If the jackpot is triggered, the funds in the jackpot are evenly divided among the players that answered the question correctly. The allocation of the wagers from each player is discussed in further detail below with respect to FIG. 4.

In an operation 260, the player may elect to play again or to return to the game lobby. If the player elects to play again, a same wager amount as wagered for the previous trivia question is deducted from the player's account balance and the player is placed into a game room as in operation 230. If the player elects to return to the game lobby, the player may select a new category and wager amount as in operations 210 and 220. Alternatively, the player may exit the system.

Figure 3:
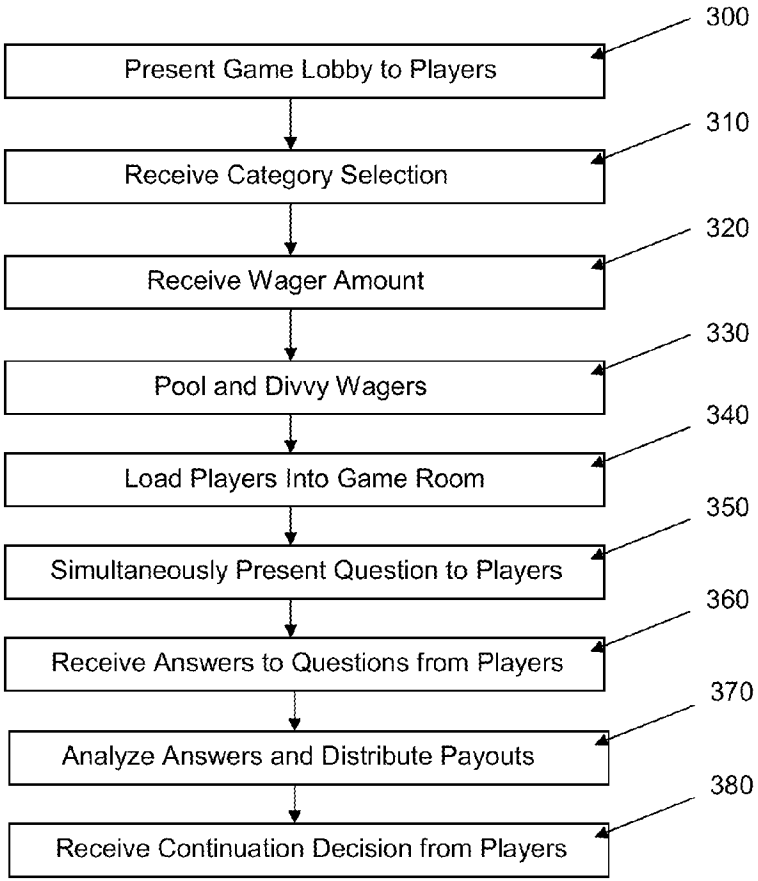
FIG. 3 is a flow diagram illustrating operations performed by one or more servers in accordance with a representative embodiment.

FIG. 3 is a flow diagram illustrating operations performed by one or more servers in accordance with a representative embodiment. The operations are not limited solely to those described below and additional, fewer, or different operations may be performed according to alternative embodiments. While the operations below are generally discussed with respect to operations performed by a single server, any number of servers may be utilized to perform the operations. As such, references to operations performed by a single server is meant to include operations performed by multiple servers operating together.

In an operation 300, a server presents a game lobby to a player. In a representative embodiment, the game lobby is presented over the Internet via a website controlled by the server. Players may navigate to the website via a browser executed by a remote computing device.

Within the game lobby, players may be presented with various options. A player may set up an account and submit money which may be used to fund subsequent wagers. As such, the server receives and stores personal and account information from the player. Players may submit money via electronic fund transfers, check, wire, or any other method known to those of skill in the art. In an embodiment, the players may purchase and cash out game credits in a secure page. Such a page may be referred to as a cashier page.

In an operation 310, the server receives a selection from the player of a category from which a subsequent trivia question is to be chosen and presented to the player. In an embodiment, the server may present the player with a variety of possible categories of trivia questions from which the player may select. The categories may be presented in the game lobby or may be presented on another web page to which the player may navigate from the game lobby.

In an operation 320, the server receives a wager amount from the player. The server may display in the game lobby a variety of wager amounts which the player may wager on a trivia question. These wager amounts are predetermined by a system administrator. The player may select from the wager amounts displayed by the server.

In an operation 330, first portions of the wagers from a plurality of players are pooled together into a payout pool. In a representative embodiment, the wagers are pooled in real time during a waiting period having a predetermined duration. The total amount in the payout pool may be updated in real time with each new player and displayed to all players. In another representative embodiment, only portions of wagers from wagers of an equal amount are pooled together. In various embodiments, additional portions of the wagers may be further allocated as discussed below with respect to FIG. 4.

In an operation 340, the server loads the players into a game room. In a representative embodiment, the players are periodically loaded from the game lobby into the game room. For example, the players may be collectively loaded into game rooms every 30 seconds. In an alternative embodiment, the players may be independently loaded into game rooms after they have selected a category and wager amount. In additional embodiments, a minimum number of players per game room may be established. If the total quantity of eligible players to enter a particular game room (e.g., quantity of players that select a given trivia category or particular wager amount) is below a predetermined threshold, the players are returned to the lobby and the players' respective wager amounts are added back to the players' respective account balances. The predetermined threshold may be any quantity of players. For example, if the minimum number of player's per game room is two and only one player is eligible to enter the game room, the player is returned to the lobby and the player's wager amount is added back to the player's account balance.

In an operation 350, the server simultaneously presents a trivia question from the selected category to each of the players in the game room. In an embodiment, the trivia question is presented a predetermined amount of time after the players have been collectively loaded into the game room. In an alternative embodiment where the players are independently loaded into the game room, the trivia question may be presented a predetermined amount of time after the final player has been loaded into the game room. The quantity of players loaded into the game room may be set by an administrator. If the total number of players exceeds the quantity of allowed player in a single game room, additional game rooms may be utilized for the excess players. In an alternative embodiment, there is no limit to the number of players in each game room.

In a representative embodiment, the trivia question is a multiple choice question. The multiple choice question includes a predetermined number of possible answers to the question from which the users may choose. In alternative embodiments, the trivia question may have any form known to those of skill in the art. For example, the trivia question may be a true or false question, a fill-in the blank question, etc.

The server receives answers to the trivia question from the players in an operation 360. In a representative embodiment, the players are given a small predetermined amount of time to submit an answer to the question. For example, the players may be given 15 seconds or less to submit an answer. The small amount of time reduces the opportunity for a player to cheat by consulting outside references to determine the answer to the trivia question.

In an operation 370, the server compares the answers received from each of the players to the correct answer, thereby determining which players have submitted the correct answer. The server then distributes payouts accordingly. The players that answered incorrectly lose their wager. The payouts are distributed as discussed below with respect to FIG. 4. In a representative embodiment, the server presents a results screen on which the results to the trivia question and the associated payouts are displayed.

In an operation 380, the server receives a continuation decision from the player. In a representative embodiment, the server presents the player with the option to play again or to return to the game lobby. If the server receives a request to play again, the same amount wagered for the previous trivia question is deducted from the player's balance and the player is loaded into a game room in accordance with operation 340. The game room into which the player is loaded corresponds to the same trivia category as the previous trivia question. If the server receives a request to return to the game lobby, the server presents the game lobby to the player. As such, the player may select a different trivia category, a different wager amount, or choose to exit the game. The player may also exit the game by simply closing the browser.

In a representative embodiment, the server begins a timer at the conclusion of the previous trivia question. The player is thus given a set amount of time to input a continuation decision. If the player does not input a continuation decision prior to the expiration of the timer, the player is automatically returned to the game lobby.

Figure 4:
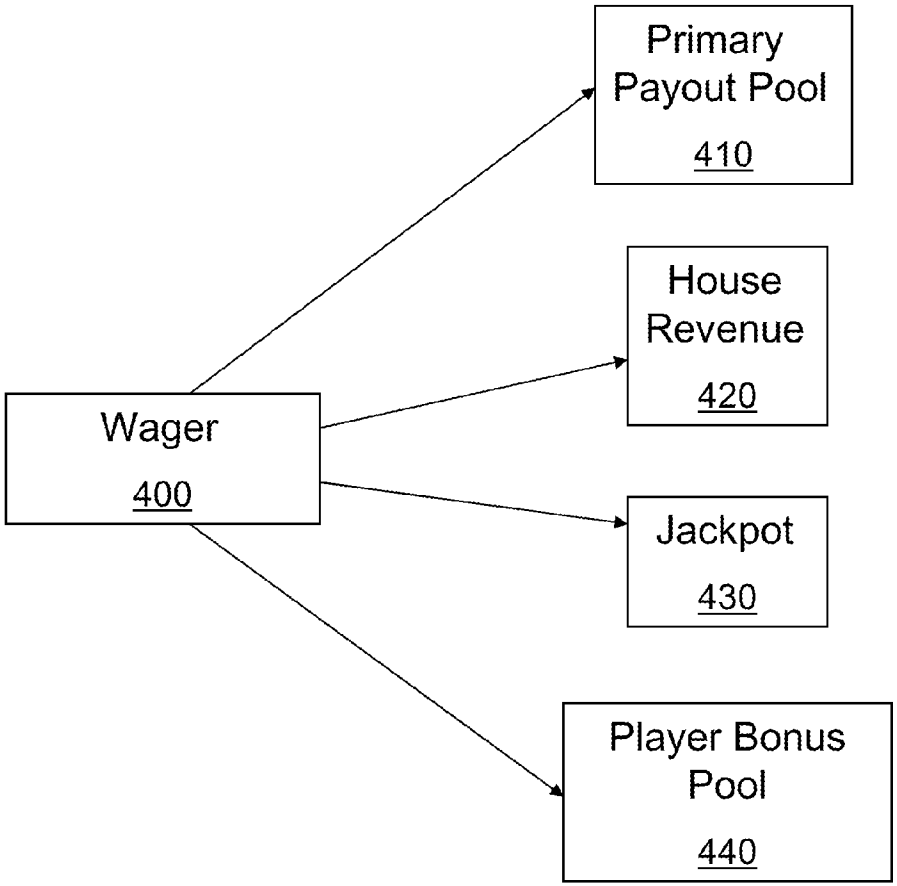
FIG. 4 is a block diagram illustrating the allocation of funds from a wager pool in accordance with a representative embodiment.

FIG. 4 is a block diagram illustrating the allocation of funds from a wager 400 in accordance with a representative embodiment. A first portion of wager 400 is distributed into a primary payout pool 410. Primary payout pool 410 is later divided among the players from a given game room that answer the associated trivia question correctly. In a representative embodiment, 92% of wager 400 is allocated to primary payout pool 410, although in alternative embodiments a different percentage of wager 400 may be allocated to primary payout pool 410. A second portion of wager 400 is allocated as house revenue 420. In a representative embodiment, 4% of wager 400 is allocated as house revenue 420, although in alternative embodiments a larger or smaller percentage of each wager 400 may be allocated to the house.

A third portion of wager 400 is allocated to a jackpot 430. In an embodiment, jackpot 430 includes funds from wagers from each player that enters a game room regardless of the particular game room, the selected wager amount, or the selected category of trivia question. At any given time, a given number of game rooms may be established. In an embodiment, all game rooms are established and concluded at the same time. The total amount of the jackpot is divided into the game rooms. Each game room is thereby allocated a pro rata share of jackpot 430. In accordance with a representative embodiment, the pro rata share of jackpot 430 for a game room is triggered if at least a specified percentage of the players in the game room answer the trivia question correctly. For example, if the specified percentage is greater than 92%, the pro rata share of jackpot 430 is divided between the players that answer correctly only if greater than 92% of the players in the given game room answer the trivia question correctly. If fewer than the specified percentage of players answers the question correctly, the pro rata share of jackpot 430 is not awarded to any of the players and is returned to jackpot 430. Upon commencement of the next set of game rooms, jackpot 430 is divided into the next set of game rooms so that each game room has a pro rata share of jackpot 430.

In alternative embodiments, the jackpot may be allocated between the game rooms based on the wager amounts for each game room. For example, game rooms that have higher wager amounts may be allocated a larger portion of the jackpot than game rooms with small wager amounts. In additional embodiments, the system may incorporate multiple jackpots and each jackpot may only pool funds from wagers of players who select same categories of trivia questions or from players who select same wager amounts. In further embodiments, the current amount of jackpot 430 is displayed and routinely updated to advertise the jackpot amount to the players. For example, the current amount of jackpot 430 may be displayed in the game lobby, in the game room, on the results screen, or in any other desired screen or area.

A fourth portion of wager 400 is allocated to a player bonus pool 440. In a representative embodiment, 2% of each wager 400 is allocated to player bonus pool 440, although different amounts may be utilized depending on the specific embodiment. Each player earns a predetermined point for every credit wagered. The points may have a monetary value that is equal to a total amount points issued by the entire system divided by the total amount collected in player bonus pool 440. At predetermined time intervals (e.g., every 7 days), the system converts the points accumulated by each player to a monetary value depending on the value of each point (as determined based on the total amount of funds in player bonus pool 440) and adds the monetary value to each player's account balance.

In an alternative embodiment, players may also earn points and bonuses from player bonus pool 440 by referring new players. In such an embodiment, a first player is made aware of the system or website by a second player. When the first player creates an account with the system, the first player indicates that the second player referred the first player to the system. Each time the first player submits a subsequent bet, the second player will receive points based on the amount wagered by the first player. At predetermined time intervals (e.g., every 7 days), the system converts the player referral points accumulated by each player to a monetary value depending on the value of each point (as determined based on the total amount of funds in player bonus pool 440) and adds the monetary value to each player's account balance. Such a bonus system thereby promotes further marketing of the system by the players themselves.

Figure 5:
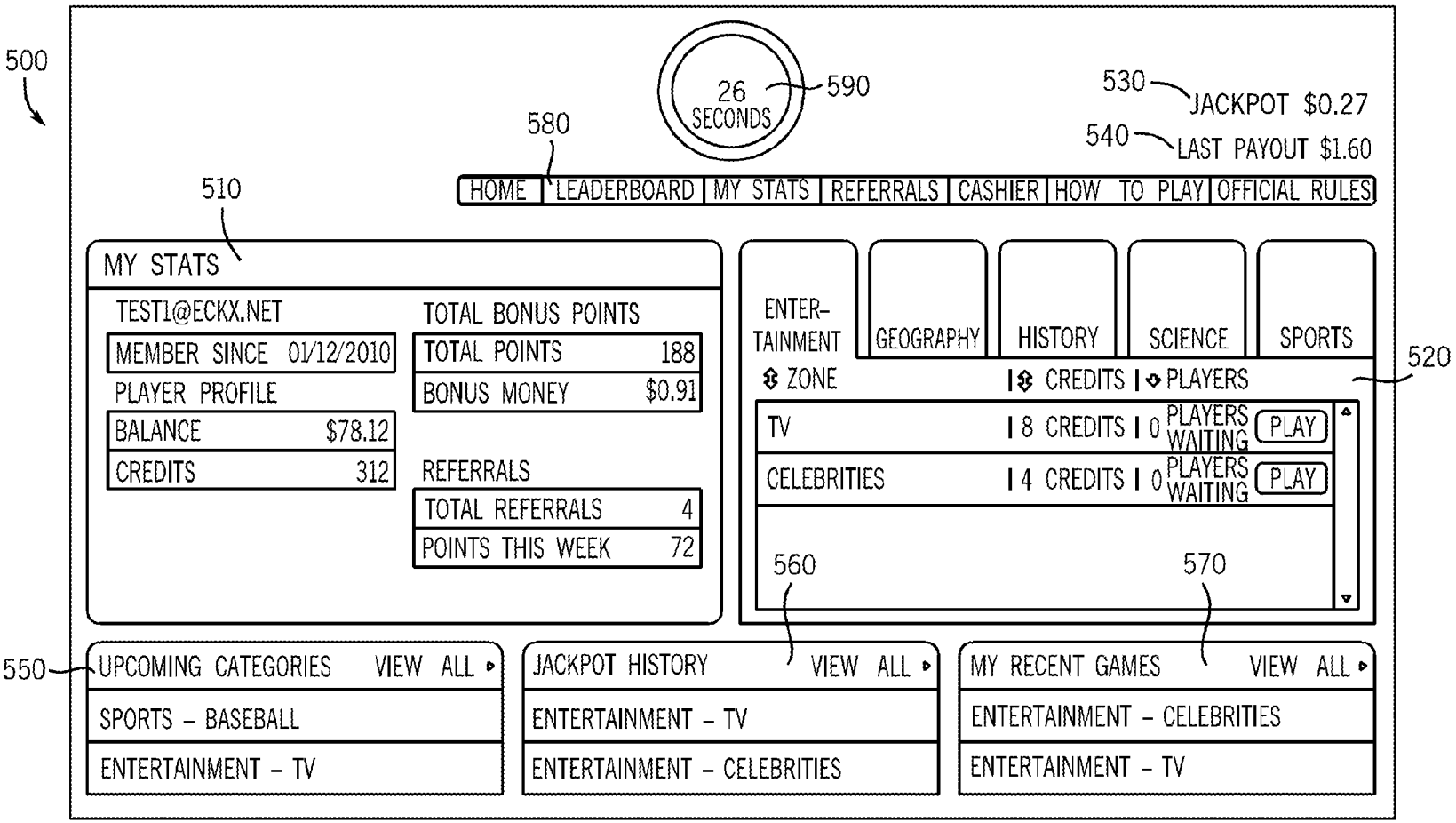
FIG. 5 is a graphical user interface (GUI) associated with a game lobby in accordance with a representative embodiment.

FIG. 5 is a GUI associated with a game lobby 500 in accordance with a representative embodiment. Game lobby 500 is depicted according to a first representative embodiment. Alternative embodiments of game lobby 500 could incorporate fewer or additional features. Game lobby 500 includes a statistics display 510. Statistics display 510 includes a player profile which details various statistics associated with the corresponding player. For example, statistics display 510 may display a current account balance for the player, a total number of credits of the player, current amount of bonus points, number of games played, and a win percentage. Statistics display 510 may also include information associated with the total amount of bonus points accumulated by the player and number of players referred by the player. For example, statistics display 510 may display total bonus points accumulated by the player, total bonus money received, an amount of a last jackpot earned, a total amount of all jackpots earned, total number of player referrals, and points earned based on those referrals.

A wager screen 520 may also be displayed as part of game lobby 500. Wager screen 520 includes several different category selections (e.g., entertainment, geography, history, science, sports, etc.). Wager screen 520 displays subcategories within each category. For example, the entertainment category includes a TV subcategory and a celebrities subcategory. Wager screen 520 also displays game rooms associated with each subcategory, which includes a number of credits required to participate and a number of players that have already entered the game room. Wager screen 520 further includes an input (e.g., a "Play" button) for each game room, which a player may select to enter the game room.

Game lobby 500 also displays a current jackpot amount 530 and a jackpot payout amount 540. Game lobby 500 also displays upcoming categories and subcategories 550 which a player may join at a subsequent time, a jackpot history 560 that indicates jackpot amounts that were recently awarded, and a player's recent games 570 which displays recent categories in which the player has participated and the result. Game lobby 500 also includes several links 580 to additional windows, which include a player leaderboard, a player's statistics, a referrals page, a cashier, and various rules pages. Timer 590 displays an amount of time before the next round of questions is initiated.

Figure 6:
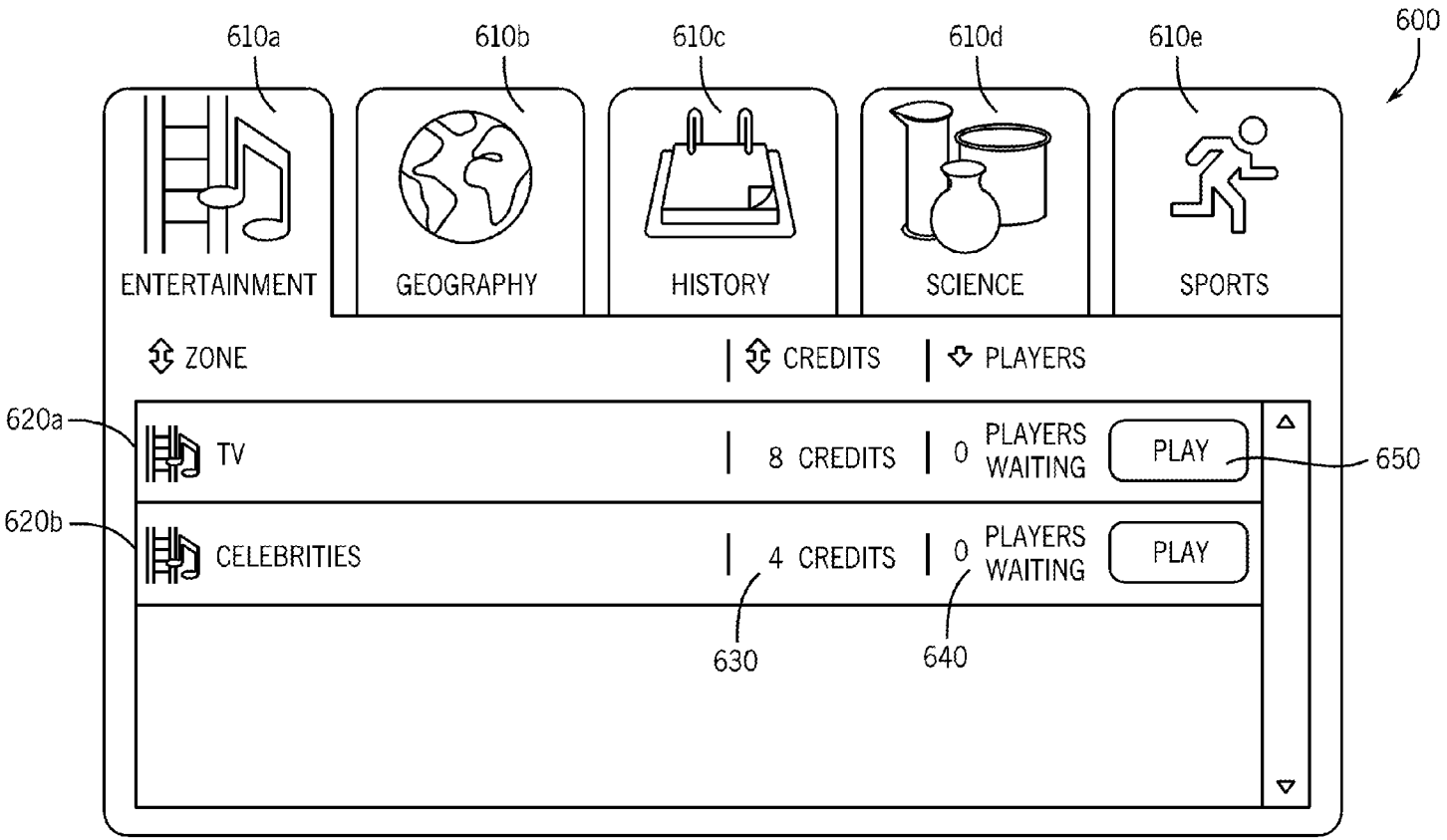
FIG. 6 is a GUI associated with a wager screen in accordance with a representative embodiment.

FIG. 6 is a GUI associated with a wager screen 600 in accordance with a representative embodiment. Wager screen 600 is depicted according to a first representative embodiment. Alternative embodiments of wager screen 600 could incorporate fewer or additional features. Wager screen 600 includes several different category selections. These categories include entertainment 610*a*, geography 610*b*, history 610*c*, science 610*d*, and sports 610*d*. Upon receiving a selection of a specific category, wager screen 600 displays subcategories within the selected category. For example, the entertainment category 610*a* includes a TV subcategory 620*a* and a celebrities subcategory 620*b*. Wager screen 600 also displays game rooms associated with each subcategory, which includes a number of credits 630 required to participate and a number of players 640 that have already entered the game room. Wager screen 600 further includes an input 650 (e.g., a "Play" button) for each game room, which a player may select to enter the game room.

Figure 7:
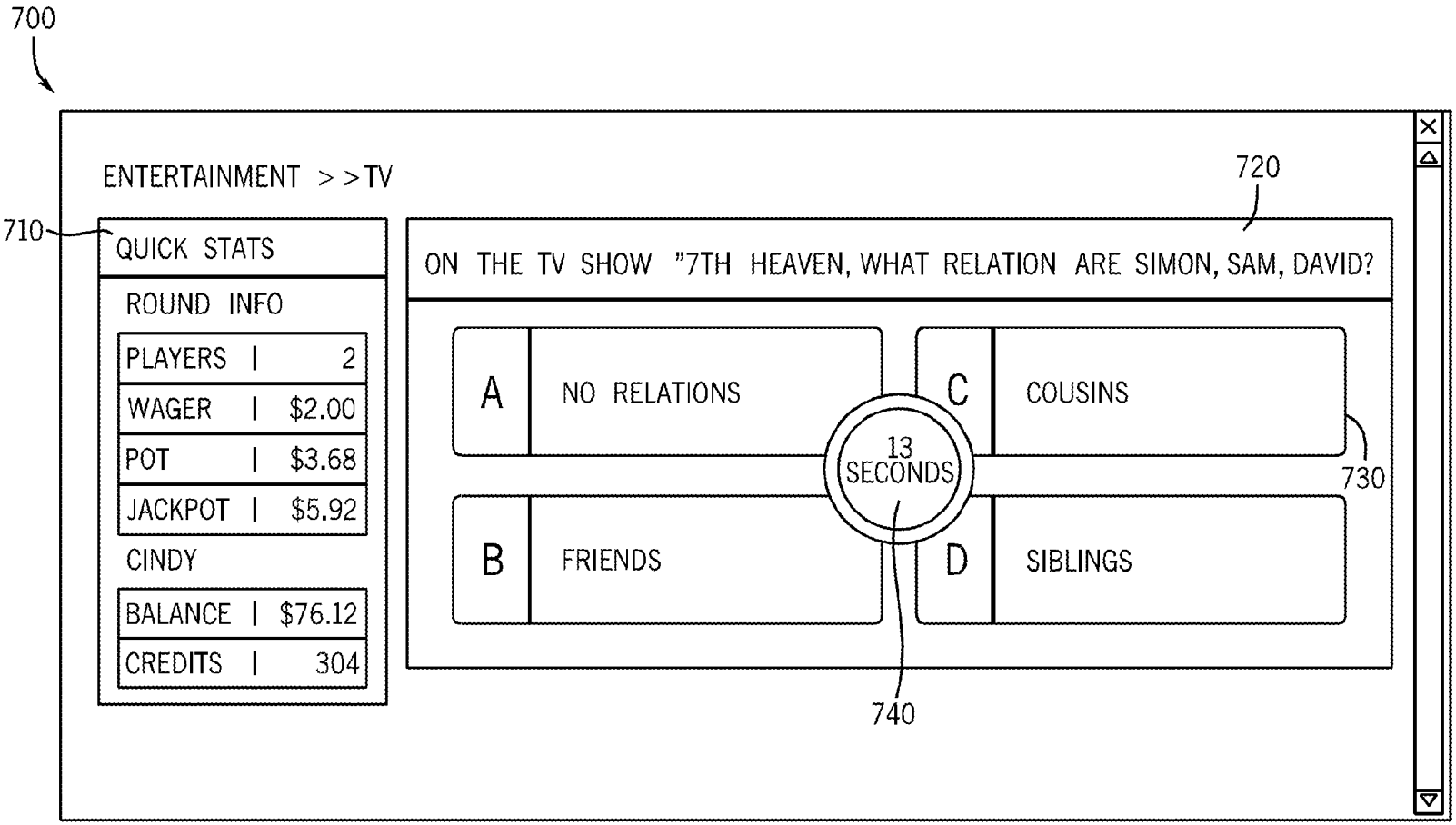
FIG. 7 is a GUI associated with a trivia question screen in accordance with a representative embodiment.

FIG. 7 is a GUI associated with a trivia question screen 700 in accordance with a representative embodiment. Trivia question screen 700 is depicted according to a first representative embodiment. Alternative embodiments of trivia question screen 700 could incorporate fewer or additional features. Trivia question screen 700 displays the question associated with the selected category and subcategory to the players. Trivia question screen 700 includes a statistics display 710. Statistics display 710 displays information about the present round, for example, the number of players, the wager amount, the available pot, and the available jackpot. Statistics display 710 also displays information about the specific player, for example, the player's balance and the players total number of credits.

Trivia question screen 700 displays a question 720 that corresponds to the selected category and subcategory and several possible answers 730 from which the player may select. A timer 720 displays the amount of time the player has to answer the question.

Figure 8:
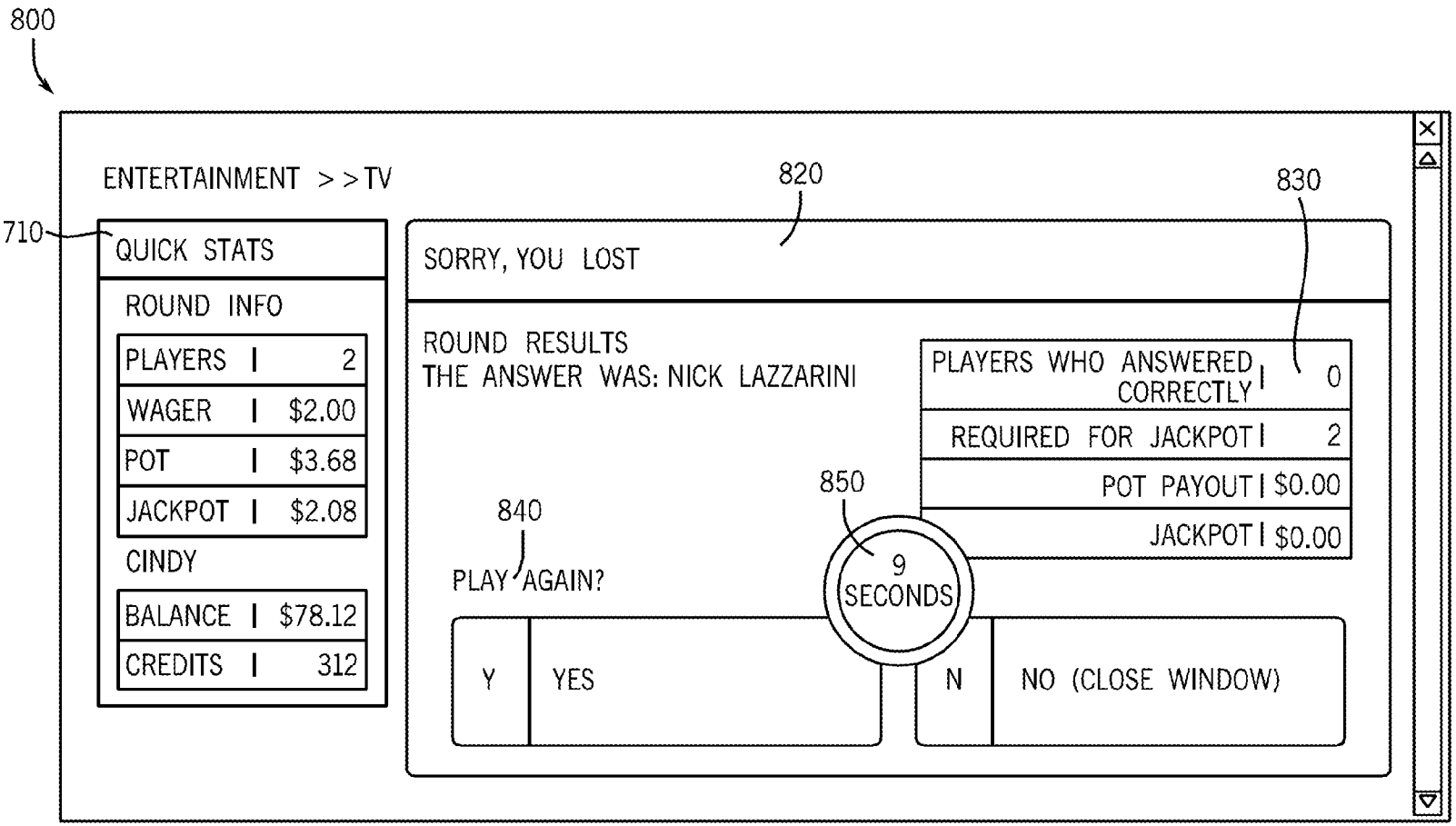
FIG. 8 is a GUI associated with a results screen in accordance with a representative embodiment.

FIG. 8 is a GUI associated with a results screen 800 in accordance with a representative embodiment. Results screen 800 is depicted according to a first representative embodiment. Alternative embodiments of results screen 800 could incorporate fewer or additional features. Results screen 800 displays a summary of the results of the previous question. Results screen 800 displays an indication 820 of whether the player answered the previous question correctly. A results summary 830 displays the correct answer, the number of players who answered correctly, the number of correct answers required for the jackpot to be earned, the total pot payout, and the total jackpot payout. Results screen 800 also presents a continuation option 840 to the player which allows the player to elect to participate in another question in the same category and subcategory and with the same wager amount. Alternatively, the player can elect to return to the game lobby. A timer 850 displays an amount of time the player has to enter a continuation command. If the player does not issue a continuation command prior to expiration of timer 850, the player will be returned to the game lobby. Results screen 800 may also include a statistics screen 810 which displays various statistics about the previous rounds and the specific player.

The system described above can be implemented with any type of game of chance or skill. It is not limited to the embodiment of trivia questions. The gaming engine and odds and pay system described can be utilized in a variety of different formats and applications.

It is important to understand that any of the embodiments described herein may be implemented as computer-readable instructions stored on a tangible computer-readable medium. Upon execution by a processor, the computer-readable instructions can cause a computing device to perform operations to implement any of the embodiments described herein.

The foregoing description of exemplary embodiments has been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments and with various modifications as are suited to the particular use contemplated. In addition, one or more flow diagrams were used herein. The use of flow diagrams is not intended to be limiting with respect to the order in which operations are performed.

What is claimed is:

1. A method comprising:

receiving a wager amount communicated over a network to a gaming server from each of a first plurality of players;

allocating a first portion of each wager amount to a payout pool using the gaming server;

allocating a second portion of each wager amount to a jackpot using the gaming server;

causing a simultaneous presentation of a question to the first plurality of players using the gaming server;

receiving, at the gaming server, a plurality of answers to the question from the first plurality of players;

allocating, using the gaming server, pro rata shares of the payout pool to each player of the first plurality of players that answered the question correctly; and in response to a specified percentage of the first plurality of players answering the question correctly, allocating pro rata shares of the jackpot to each of the first plurality of players that answers the question correctly using the gaming server;

receiving a wager amount at the server from each of a second plurality of players, wherein said second plurality of players comprises said first plurality of players and a third plurality of players, wherein the wager amount received from each of the first plurality of players is equal, and wherein the wager amount received from each of the third plurality of players is different than the wager amount received from each of the first plurality of players;

placing the first plurality of players in a first game room corresponding to a first question;

and placing at least a portion of the third plurality of players in a second game room corresponding to a second question.

2. The method of claim 1, further comprising receiving a selection of a category of question from each of the first plurality of players, wherein the question corresponds to the category of question.

3. The method of claim 1, wherein said causing a simultaneous presentation of a question comprises communicating the question to a plurality of browsers and triggering the plurality of browsers to display the question at a same time.

4. The method of claim 1, further comprising allocating a third portion of each wager amount as house revenue using the gaming server.

5. The method of claim 1, further comprising allocating a fourth portion of each wager amount as a player referral bonus, wherein at least a portion of the player referral bonus is allocated to a player that referred the player from which the respective wager amount is received.

6. The method of claim 5, further comprising awarding at least one point to one of the first plurality of players based on the wager amount and crediting an account balance for the one of the first plurality of players based on the at least one point.

7. The method of claim 1, further comprising communicating a plurality of possible wager amounts to each of the first plurality of players, and wherein said receiving a wager amount comprises receiving a selection of one of the plurality of possible wager amounts from each of the first plurality of players.

8. The method of claim 1, wherein the question is a multiple choice trivia question, wherein said causing a simultaneous presentation of a question comprises causing a presentation of a predetermined number of possible answers to the first plurality of players, and wherein said receiving a plurality of answers further comprises receiving a selection of one of the predetermined number of possible answers from each of the first plurality of players.

9. the method of claim 1, further comprising dividing the jackpot among the first and second game rooms, wherein said allocating pro rata shares of the jackpot comprises allocating pro rata shares of a divided portion of the jackpot to each of the first plurality of players that answered the question correctly.

10. A system comprising:

one or more gaming servers connected to a plurality of remote terminals associated with a first plurality of players, wherein the one or more gaming servers are configured to:

receive wager amounts from each of the plurality of remote terminals;

allocate a first portion of each wager amount to a payout pool;

allocate a second portion of each wager amount to a jackpot;

send instructions to the plurality of remote terminals to simultaneously present a question to the first plurality of players;

receive a plurality of answers to the question from the plurality of remote terminals;

allocate pro rata shares of the payout pool to each player of the first plurality of players that answers the question correctly; and in response to a specified percentage of the first plurality of players answering the question correctly, allocate pro rata shares of the jackpot to each of the first plurality of players that answers the question correctly; wherein the one or more game servers are further configured to:

receive a wager amount from each of a second plurality of players, wherein said second plurality of players comprises the first plurality of players and a third plurality of players, wherein the wager amount received from each of the first plurality of players is equal, and wherein the wager amount received from each of the third plurality of players is different than the wager amount received from each of the first plurality of players;

place the first plurality of players in a first game room corresponding to the question, and place at least a portion of the third plurality of players in a second game room corresponding to a second question.

11. The system of claim 10, wherein the one or more gaming servers are further configured to receive a selection of a category of question from each of the plurality of remote terminals, wherein the question corresponds to the category of question.

12. The system of claim 10, wherein the one or more gaming servers are further configured to allocate a third portion of each wager amount as house revenue.

13. The system of claim 10, wherein the one or more gaming servers are further configured to communicate the question to a plurality of browsers at the remote terminals and trigger the plurality of browsers to display the question at a same time in response to the instructions to the plurality of remote terminals.

14. The system of claim 10, wherein the one or more gaming servers are further configured to allocate a fourth portion of each wager amount as a player referral bonus, wherein at least a portion of the player referral bonus is allocated to a player that referred the player from which the respective wager amount is received.

15. The system of claim 14, wherein the one or more gaming servers are further configured to award at least one point to one of the first plurality of players based on the wager amount and credit an account balance for the one of the first plurality of players based on the at least one point.

16. The system of claim 10, wherein the one or more servers are further configured to:

cause the plurality of remote terminals to present of a plurality of possible wager amounts to each of the first plurality of players; and receive a selection of one of the plurality of possible wager amounts from each of the first plurality of players.

17. The system of claim 10, wherein the one or more servers are further configured to divide the jackpot among the first and second game rooms, and, in response to a specified percentage of the first plurality of players answering the question correctly, to allocate pro rata shares of a divided portion of the jackpot to each of the first plurality of players that answered the question correctly.

18. A tangible computer-readable medium having stored thereon, computer executable instructions that, if executed by a computing device, cause the computing device to perform a method comprising:

receiving a wager amount from each of a plurality of players;

allocating a first portion of each wager amount to a payout pool;

allocating a second portion of each wager amount to a jackpot;

simultaneously presenting a question to the plurality of players;

receiving a plurality of answers to the question from the plurality of players;

allocating pro rata shares of the payout pool to each player of the plurality of players that answers the question correctly; and in response to a specified percentage of the plurality of players answering the question correctly, allocating pro rata shares of the jackpot to each of the plurality of players that answers the question correctly; wherein the computer-executable instructions, if executed by a computing device, further cause the computing device to perform a method comprising receiving a wager amount at the server from each of a second plurality of players, wherein said second plurality of players comprises said first plurality of players and a third plurality of players, wherein the wager amount received from each of the first plurality of players is equal, and wherein the wager amount received from each of the third plurality of players is different than the wager amount received from each of the first plurality of players;

placing the first plurality of players in a first game room; and placing at least a portion of the third plurality of players in a second game room.

19. The tangible computer-readable medium of claim 18, wherein the computer-executable instructions, if executed by a computing device, further cause the computing device to perform a method comprising receiving a selection of a category of question from each of the first plurality of players, wherein the question corresponds to the category of question.

20. The tangible computer-readable medium of claim 18, wherein the computer-executable instructions, if executed by a computing device, further cause the computing device to perform a method comprising allocating a third portion of each wager amount as house revenue.

21. The tangible computer-readable medium of claim 18, wherein said causing a simultaneous presentation of a question comprises communicating the question to a plurality of browsers and triggering the plurality of browsers to display the question at a same time.

22. The tangible computer-readable medium of claim 18, wherein the computer-executable instructions, if executed by a computing device, further cause the computing device to perform a method comprising allocating a fourth portion of each wager amount as a player referral bonus, wherein at least a portion of the player referral bonus is allocated to a player that referred the player from which the respective wager amount is received.

23. The tangible computer-readable medium of claim 22, wherein the computer-executable instructions, if executed by a computing device, further cause the computing device to perform a method comprising awarding at least one point to one of the first plurality of players based on the wager amount and crediting an account balance for the one of the first plurality of players based on the at least one point.

24. The tangible computer-readable medium of claim 18, wherein the computer-executable instructions, if executed by a computing device, further cause the computing device to perform a method comprising presenting a plurality of possible wager amounts to each of the first plurality of players and receiving a selection of one of the plurality of possible wager amounts from each of the first plurality of players.

25. The tangible computer-readable medium of claim 20, wherein the question is a multiple choice trivia question, wherein said causing a simultaneous presentation of a question comprises causing a presentation of a predetermined number of possible answers to the first plurality of players, and wherein said receiving a plurality of answers further comprises receiving a selection of one of the predetermined number of possible answers from each of the first plurality of players.

26. The tangible computer-readable medium of claim 18, wherein the computer-executable instructions, if executed by a computing device, further cause the computing device to perform a method comprising dividing the jackpot among the first and second game rooms, wherein said allocating pro rata shares of the jackpot comprises allocating pro rata shares of a divided portion of the jackpot to each of the first plurality of players that answers the question correctly.

* * * * *